US005261821A

United States Patent [19]

Shic

[11] Patent Number: 5,261,821

[45] Date of Patent: Nov. 16, 1993

[54] TRAINING DEVICE FOR MARTIAL ARTS

[76] Inventor: John Shic, 763 NW. 83rd Dr., Coral Springs, Fla. 33071

[21] Appl. No.: 988,414

[22] Filed: Dec. 29, 1992

[51] Int. Cl.[5] ..... A63B 69/20

[52] U.S. Cl. ..... 434/247; 482/83; 482/86; 482/90

[58] Field of Search ..... 482/83, 85-90; 242/55.2; 174/102 R; 434/247

[56] References Cited

U.S. PATENT DOCUMENTS

| | | | |
|---|---|---|---|
| 516,719 | 3/1894 | Daniel . | |
| 1,202,190 | 10/1916 | Kern | 242/55.2 |
| 2,477,362 | 7/1949 | Cavalieri | 242/55.2 |
| 3,788,573 | 1/1974 | Thompson et al. | 242/55.2 |
| 4,084,811 | 4/1978 | Kyo | 272/76 |
| 4,093,139 | 6/1978 | Amoretti | 242/55.2 |
| 4,173,336 | 11/1979 | Perry | 272/76 |
| 4,201,379 | 5/1980 | Williams | 272/76 |
| 4,309,029 | 1/1982 | Tomko | 272/76 |
| 4,595,431 | 6/1986 | Bohannon, Jr. et al. | 174/102 R X |
| 4,662,630 | 5/1987 | Dignard et al. | 272/76 |
| 4,677,418 | 6/1987 | Shalver | 174/102 R X |
| 4,787,625 | 11/1988 | Chaloux | 482/87 |
| 4,791,246 | 12/1988 | Neuroch | 174/102 R |
| 4,817,941 | 4/1989 | McCorry | 482/87 X |
| 4,932,652 | 6/1990 | Beall, III | 272/76 |
| 5,183,451 | 2/1993 | Hautamaki | 482/83 X |

FOREIGN PATENT DOCUMENTS

| | | | |
|---|---|---|---|
| 2243087 | 10/1991 | United Kingdom | 482/87 |

*Primary Examiner*—Gene Mancene
*Assistant Examiner*—L. Thomas
*Attorney, Agent, or Firm*—Malin, Haley, DiMaggio & Crosby

[57] ABSTRACT

A martial arts striking device comprising an impact section having a plurality of rods to define a generally cylindrical configuration. The rods are supported by cap sections disposed at opposite ends of the rods to firmly hold the rods, and a central axle with compressions means attached thereto to adjust the resistance of the impact section.

8 Claims, 3 Drawing Sheets

TRAINING DEVICE FOR MARTIAL ARTS

BACKGROUND OF THE INVENTION

1. Field of the Invention

This invention relates generally to a martial arts striking device, and more particularly, to a device that receives foot kicks, forearm thrusts, head thrusts, hand thrusts, or the like to train a student of the martial arts, kick boxing, or boxing to break boards, bricks, or the like.

2. Description of the Prior Art

Numerous martial arts hitting devices that are used to train students in the proper method of striking an opponent are known in the prior art. Such striking devices include punching bags, striking bag platforms, simulated leg kicking devices, and other hitting surfaces.

For instance, U.S. Pat. No. 516,719, issued to Daniel, discloses a striking bag disk that will cause a punching bag to rebound quickly therefrom once struck, and that will keep the amount of wear to the bag at a minimum. Another device, disclosed in U.S. Pat. No. 4,932,652, issued to Beall, consists of a martial arts training apparatus which resembles the movement and function of a human leg when kicked, wherein this apparatus bends at its center in response to a well executed low kick. A third device, disclosed in U.S. Pat. 4,662,630, issued to Dignard, comprises a striking apparatus having a planar striking member, such as a karate kick board, which is resiliently mounted and adjustable to different vertical heights.

While the foregoing inventions disclose devices to practice proper kicking and punching techniques, none of them provide a device for object breaking training. The present device provides a striking apparatus which is more versatile in positioning than the aforementioned and more importantly, that trains martial arts students to split boards, bricks, and other objects, while increasing the toughness and tolerance of the hands, feet, head, forearms, etc. Since a device that improves striking technique, object breaking ability, and pain tolerance is unknown in the prior art, there still remains a need for a martial arts striking apparatus that will train a student in the foregoing area. Such a device may be found in the present invention, wherein its purpose is to facilitate this area of the art. The present invention addresses this need by providing an apparatus that is constructed of a rigid material and allows a student to practice the technique of breaking objects at varying positions while increasing the tolerance for pain.

SUMMARY OF THE INVENTION

The present invention addresses the foregoing shortcomings found in the prior art by providing a martial arts striking device that allows students in the martial arts to practice and improve their foot kick and hand thrust techniques in splitting objects, conditions the hands, feet and other body parts to tolerate the force of impact, and facilitates striking at various levels and positions. The striking device consists of an impact section, a support section, and a base section.

The impact section, or impact block, comprises a plurality of rods of equal length. The rods are arranged adjacent to each other in a substantially cylindrical configuration. This collection of rods defines the striking surface. The thickness of the rods may be varied to adjust the flexibility and breaking resistance of the impact block to foot kicks and hand thrusts. The rods may be fabricated from plastic, wood, or the like.

The support section consists of two end caps for supporting the rods along a central axle. Each end of the group of rods is supported by a corresponding cap which maintains the plurality of rods in a cylindrical configuration. The central axle extends through an aperture in each end cap and contains a threaded section and an eye bolt at each end. The threaded section of the axle accommodates threaded sleeves that, when tightened, compress the group of rods to create a harder surface by increasing the resistance and decreasing the flexibility of the impact block. The eye bolt facilitates mounting to a support surface. It should be noted that the central axle may be threaded at each end without an eye bolt.

The base section may be comprised of various 5 forms. The preferred embodiment of the base section comprises a planar member that may be positioned vertically or horizontally, and may be attached to a wall, table, or other structure. The impact and support sections may be securedly attached to the base section by means of base mounted brackets connected to each end cap thereof.

In an alternative embodiment, the striking device may be suspended between two supports. The device may be suspended by means of rope, nylon, or other elastic material, wherein one end of each elastic interface is secured to a corresponding support and the other end of each elastic interface is secured to a corresponding eye bolt on the support section.

In another alternative embodiment, the device may be situated and supported vertically on a platform by a base mounted bracket. The impact block may be securedly fastened to the platform and supported by means of one or two vertically extending resilient support members, depending on the rigidity and resiliency of the support members.

In accordance with the present invention, it is an object thereof to provide a martial arts striking device that will aid a person in the training of splitting wood, bricks, and the like with their hands, feet, head and other body parts.

An additional object of the instant invention is to provide a martial arts striking device that will increase the toughness and tolerance of a person's hands, feet, and the like to impact forces.

Another object of the instant invention is to provide a striking device that is versatile in its utilization.

Still another object of the instant invention is to provide a striking device that will improve a person's foot kick and hand thrust techniques.

A further object of the instant invention is to provide a striking device that is low in cost and simple in construction.

In accordance with these and other objects which will be apparent hereinafter, the instant invention will now become described with particular reference to the accompanying drawings.

DESCRIPTION OF THE PREFERRED EMBODIMENTS

Figure 2:
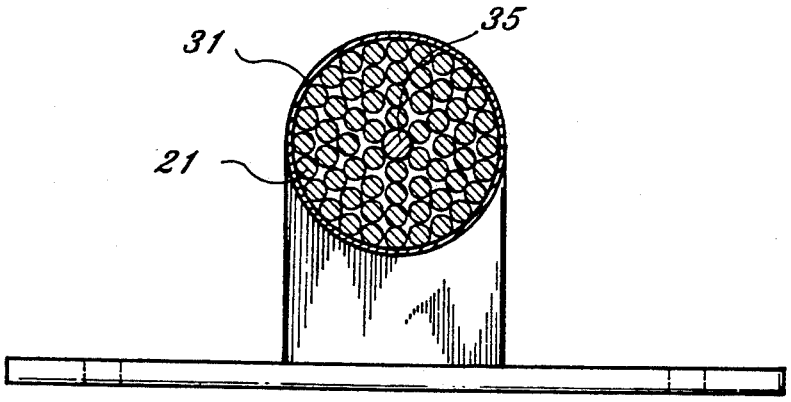
FIG. 2 is a cross sectional view of the instant invention.
Figure 3:
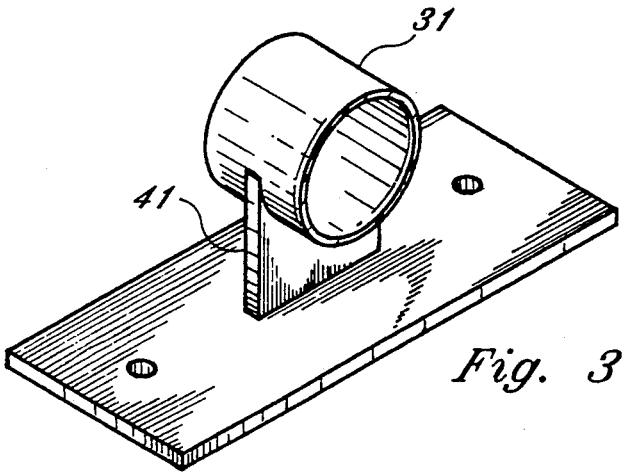
FIG. 3 is a side elevational view of the cap section of the instant invention.
Figure 1:
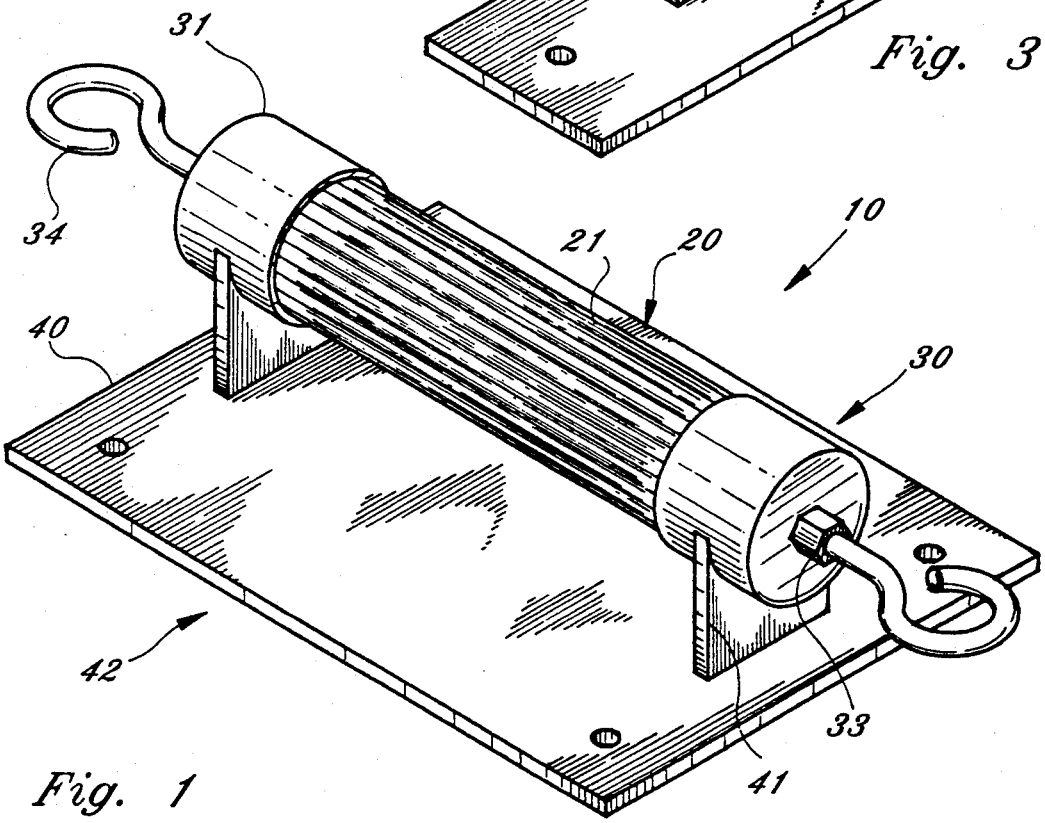
FIG. 1 is a perspective view of the instant invention.

Referring now to the drawings, FIGS. 1-6, and in particular to FIG. 1, the present invention is shown generally at 10, comprising an impact section 20, a support section 30, and a base section 40.

The impact section 20 is comprised of a plurality of rods 21 of equal length. The rods 21 are longitudinally disposed within the impact section 20 to collectively define a substantially cylindrical configuration. The collection of rods 21 are individually operatively associated with a cap 31. The thickness of the rods 21 may be varied and may be fabricated from plastic, wood, or the like.

The support section 30 consists of two end caps 31 for supporting the rods and a central axle 35. Each end of a group of rods 21 is supported by a corresponding cap 31 which maintains the plurality of rods 21 in a cylindrical configuration. A central axle 35 extends through an aperture on each end cap and protrudes therefrom. In the preferred embodiment, the central axle 35 contains a threaded section 36 and an eye bolt 34 at its ends. However, it should be noted that a central axle threaded at each end without an eye bolt would still fall within the scope of the present invention. The threaded section 36 extends beyond cap 31 and accommodates a threaded sleeve 33 at each end. The caps and threaded sleeve 33 compress the rods to create a harder surface for striking when tightened. Likewise, the caps 31 and threaded sleeves 33 may be loosened to create less resistance and more flexibility in the impact block 20. The end caps 31 facilitate mounting to a base section 40 as seen in FIG. 1. An isolated view of the cap section 31 with bracket 41 may be seen in FIG. 3.

The base section 40 is comprised of a planar member 42 and brackets 41 as evidenced in the preferred embodiment of FIG. 1. The base section 40 may be mounted to a wall, a table, or the like, and may be positioned vertically or horizontally to utilize the instant invention. The impact section 20 and support section 30 may be securedly attached to base section 40 by means of base mounted brackets 41, which are connected to end caps 31.

Figure 5:
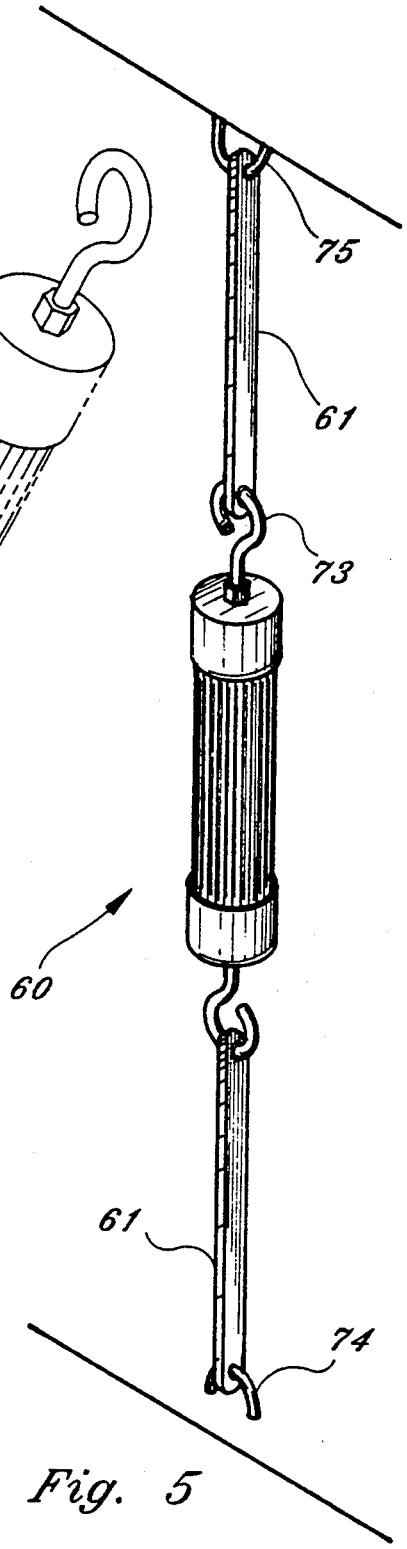
FIG. 5 is a perspective view of an alternative embodiment of the instant invention.
Figure 6:
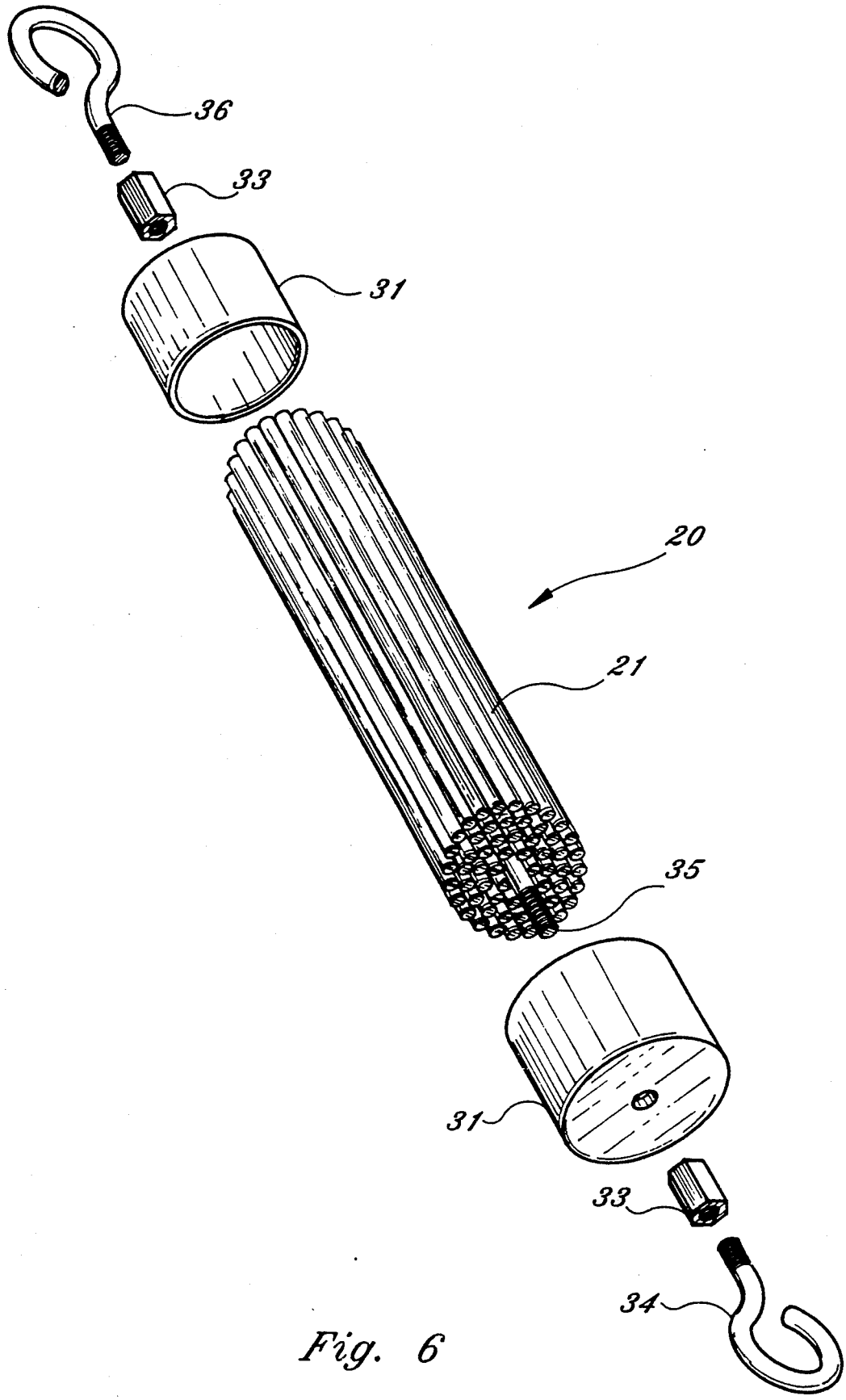
FIG. 6 is an exploded isometric view of the instant invention.

FIG. 5 illustrates an alternative embodiment of the instant invention, wherein the striking device 60 is suspended between two supports 74 and 75, such as a floor and ceiling, respectively. The striking device 60 may be suspended between the upper support 75 and the lower support 74 by means of rope, nylon, or other elastic material 61, wherein one end of each elastic interface 61 is secured to a corresponding support 74 and 75, and the other end of each elastic interface 61 is secured to a corresponding eye bolt 73 on the impact block 60.

Figure 4:
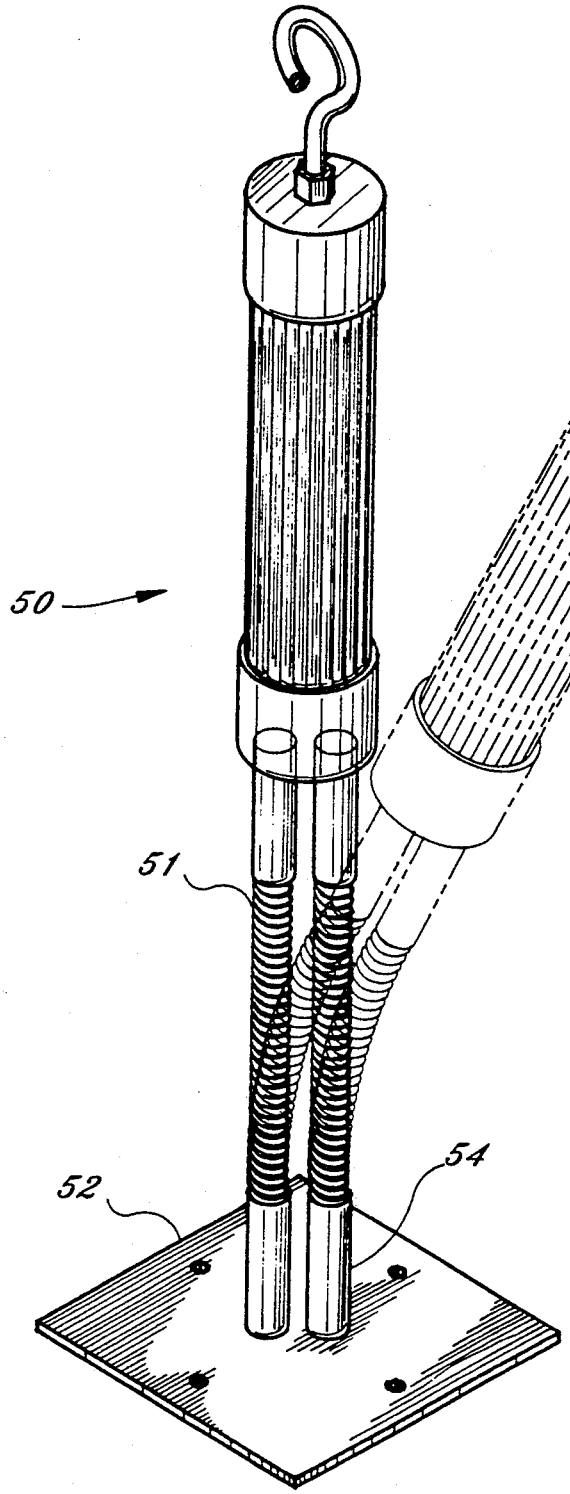
FIG. 4 is a perspective view of an alternative embodiment of the instant invention.

FIG. 4 depicts another alternative embodiment for the instant invention, wherein the striking device 50 may be situated and mounted vertically on a platform 52 by a base-mounted bracket 54. The impact block may be securedly fastened to the platform 52 and supported by means of one or two vertically extending resilient support members 51. Only one support member 51 is required if it is rigid enough to vertically support the striking device 50.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A martial arts striking device, comprising:

a plurality of rods of specified length, said rods being adjacent one another, said rods collectively defining a substantially cylindrical rod structure, said rods being substantially aligned at their ends;

means for rigidly securing said rods at their ends; and means for compressing said rods, said means for compressing including an axle having a first end and a second end, said axle centrally disposed within said cylindrical rod structure, wherein the ends of said axle project from said means for rigidly securing, each of the axle ends accommodating a corresponding sleeve such that when the sleeves are disposed on said axle ends said means for rigidly securing compresses said rods.

2. The device disclosed in claim 1, wherein said means for securing said rods are two cap enclosures coaxially disposed at opposite ends of said cylindrical rod structure.

3. The device disclosed in claim 1, wherein said axle being threaded at each end to accommodate threads disposed on an inside surface of the sleeves such that when said sleeves are tightened, said means for rigidly securing compresses said rods.

4. The device disclosed in claim 1, further including means for supporting said striking device, said means for supporting comprising at least one rigid support member mounted to said means for rigidly securing, said support members further being connected to a base member.

5. The device disclosed in claim 2, further including means for supporting said striking device, said means for supporting comprising at least one support member, said support member mounted to one of said cap enclosures, said support member further connected to a base member.

6. A martial arts striking device, comprising:

a plurality of rods of specified length, said rods being adjacent one another, said rods collectively defining a substantially cylindrical rod structure, said rods being substantially aligned at their ends;

means for rigidly securing said rods at their ends; and means for compressing said rods, wherein said device is suspended between at least two rigid supports by at least two resilient members, said resilient members having first and second ends, respectively, wherein said first end of each resilient member is connected to a corresponding support, and wherein said second end of each resilient member is connected to a corresponding end of said device.

7. The device disclosed in claim 1, wherein said axle includes an eye bolt integrally combined in at least one end of said axle.

8. A martial arts striking device comprising:

a plurality of rods of specified length having two ends, said rods collectively defining a substantially cylindrical structure, said rods being rigidly secured at each end by a cap enclosure, said cap enclosure having a somewhat centrally disposed aperture therethrough, said striking device having a centrally disposed axle, said axle having two ends, wherein each end of said axle projects from each aperture of said cap enclosure, respectively, said axle being substantially threaded at its ends to accommodate a threaded sleeve such that when said sleeves are tightened, said cap enclosures compress said rods.

* * * * *